US010723507B2

(12) United States Patent
Kraft

(10) Patent No.: US 10,723,507 B2
(45) Date of Patent: Jul. 28, 2020

(54) SYSTEM AND METHOD FOR LOCKING WALLS OF A STORAGE CONTAINER

(71) Applicant: Compact Container Systems, LLC, Boca Raton, FL (US)

(72) Inventor: Joshua J. Kraft, Tequesta, FL (US)

(73) Assignee: Compact Container Systems, LLC, Boca Raton, FL (US)

( * ) Notice: Subject to any disclaimer, the term of this patent is extended or adjusted under 35 U.S.C. 154(b) by 876 days.

(21) Appl. No.: 15/218,563

(22) Filed: Jul. 25, 2016

(65) Prior Publication Data

US 2017/0225824 A1 Aug. 10, 2017

Related U.S. Application Data

(60) Provisional application No. 62/292,951, filed on Feb. 9, 2016.

(51) Int. Cl.
*B65D 88/00* (2006.01)
*B65D 88/12* (2006.01)
(Continued)

(52) U.S. Cl.
CPC ..... *B65D 7/30* (2013.01); *B65D 88/121* (2013.01); *B65D 88/52* (2013.01); *B65D 88/522* (2013.01); *B65D 90/008* (2013.01)

(58) Field of Classification Search
CPC .... B65D 7/30; B65D 11/186; B65D 11/1833; B65D 11/184; B65D 11/1846; B65D 11/1853; B65D 88/121; B65D 88/52; B65D 90/00; B65D 11/18; B65D 9/22; B65D 9/12; B65D 21/086; B65D 1/225; B65D 2519/00875; B65D 2571/00938; B65D 7/24; B65D 11/1893; B65D 90/008; B65D 90/0006; Y10T 292/1016; Y10T 292/307; Y10T 292/1018; Y10T 292/0993; Y10T 292/0994; Y10T 292/102; Y10T 292/306;
(Continued)

(56) References Cited

U.S. PATENT DOCUMENTS 1,355,173 A * 10/1920 Shadel ..... B62D 33/02 296/13
1,813,093 A * 7/1931 Smith ..... E05B 17/0033 292/139
(Continued)

FOREIGN PATENT DOCUMENTS

CN 201264785 Y 7/2009
CN 103204330 A 7/2013
(Continued)

OTHER PUBLICATIONS

U.S. Appl. No. 13/815,638, filed Mar. 13, 2013, 150 pages.
(Continued)

*Primary Examiner* — Gideon R Weinerth
(74) *Attorney, Agent, or Firm* — Avant Law Group, LLC

(57) ABSTRACT

The present invention discloses a novel apparatus and way for securing components of a shipping container. A locking mechanism is provided having a pin, spur gear and main gear coupled together and controlled by a handle such that rotation of the handle causes rotation of the gears and translation of a locking pin used to secure adjacent components of the container.

16 Claims, 10 Drawing Sheets

(51) Int. Cl.

| | |
|---|---|
| ***B65D 8/14*** | (2006.01) |
| ***B65D 6/16*** | (2006.01) |
| ***B65D 88/52*** | (2006.01) |
| ***B65D 6/26*** | (2006.01) |
| ***B65D 90/00*** | (2006.01) |

(58) Field of Classification Search

CPC ..... Y10T 29/49826; Y10T 29/49901; Y10T 29/49902; Y10T 29/49897; Y10T 29/49899; Y10T 29/49895; Y10T 24/28; E05C 1/00; E05C 1/004; E05C 1/02; E05C 1/06; E05C 1/065; E05B 15/10; E05B 55/00; E05B 83/02; E05B 2047/002; E05B 2047/0021; E05B 2047/0022; B60P 1/6418; B60P 7/13; E04B 1/3445; E04B 1/34357; E04B 1/34315; E04B 1/34321; E04B 1/34326; E04B 1/343

USPC .... 220/7, 666, 1.5, 6, 4.28, 4.33, 4.31, 4.16; 206/600; 70/610–612, 167–169, 190; 292/22, 39, 160, 142, 279, DIG. 12, 292/DIG. 19, 138, 139, 40, 336.3; 108/56.1; 312/257.1–265.4; 217/43 R, 217/46, 47, 48

See application file for complete search history.

(56) References Cited

U.S. PATENT DOCUMENTS

| | | | | |
|---|---|---|---|---|
| 2,053,969 | A * | 9/1936 | Olds | B60P 7/13 220/1.5 |
| 3,401,814 | A * | 9/1968 | Chiswell | B65D 88/528 220/4.33 |
| 3,403,806 | A | 10/1968 | Pohl | |
| 3,612,330 | A | 10/1971 | Baer | |
| 3,866,365 | A | 2/1975 | Honigman et al. | |
| 3,872,555 | A | 3/1975 | Link et al. | |
| 3,938,861 | A * | 2/1976 | Bagwell | B60P 1/56 298/27 |
| 4,099,640 | A | 7/1978 | Nessfield et al. | |
| 4,177,907 | A | 12/1979 | Funaioli et al. | |
| 4,240,359 | A | 12/1980 | Howe | |
| 4,319,732 | A | 3/1982 | Godfrey | |
| 4,695,184 | A * | 9/1987 | Robishaw | B60P 7/13 114/249 |
| 4,726,486 | A | 2/1988 | Masuda | |
| 5,732,839 | A | 3/1998 | Schimmang et al. | |
| 5,755,472 | A | 5/1998 | Clive | |
| 6,866,160 | B2 | 3/2005 | Wang | |
| 7,874,107 | B1 | 1/2011 | Medley et al. | |
| 7,931,164 | B2 | 4/2011 | Krohn | |
| 7,984,819 | B1 | 7/2011 | Davis | |
| 8,646,638 | B2 | 2/2014 | Buskermolen et al. | |
| 2006/0043090 | A1 | 3/2006 | Ferrini | |
| 2008/0029510 | A1 | 2/2008 | Fisk | |
| 2008/0105676 | A1* | 5/2008 | Park | B65D 88/121 220/1.5 |
| 2008/0135545 | A1 | 6/2008 | Sadkin et al. | |
| 2009/0217718 | A1* | 9/2009 | Porter | E05B 47/0002 70/271 |
| 2010/0025397 | A1 | 2/2010 | Krohn | |
| 2010/0025398 | A1 | 2/2010 | Krohn | |
| 2010/0102056 | A1 | 4/2010 | Bellehumeur et al. | |
| 2012/0006816 | A1* | 1/2012 | Turnquist | B65D 88/524 220/4.33 |
| 2012/0048846 | A1 | 3/2012 | Choi | |
| 2012/0248105 | A1 | 10/2012 | Leong | |
| 2012/0318811 | A1 | 12/2012 | Leasure | |
| 2013/0020316 | A1 | 1/2013 | Hong | |
| 2013/0180981 | A1 | 7/2013 | Meijers et al. | |
| 2013/0200101 | A1* | 8/2013 | Dooley | A47J 31/404 222/129.4 |
| 2014/0144907 | A1 | 5/2014 | Giesbers et al. | |
| 2014/0144920 | A1 | 5/2014 | Meijers et al. | |
| 2014/0183186 | A1 | 7/2014 | Buskermolen et al. | |
| 2014/0263306 | A1 | 9/2014 | Brennan, Jr. | |
| 2014/0299596 | A1 | 10/2014 | Kochanowski | |
| 2015/0108121 | A1 | 4/2015 | Kraft et al. | |
| 2015/0159410 | A1* | 6/2015 | Stallbaumer | E05B 65/1006 292/139 |
| 2016/0251153 | A1* | 9/2016 | Navalon Simon | B65D 88/522 220/1.5 |
| 2016/0311613 | A1* | 10/2016 | Churbuck | B65D 88/522 |
| 2017/0210556 | A1* | 7/2017 | Kraft | B65D 7/30 |
| 2017/0225824 | A1* | 8/2017 | Kraft | B65D 7/30 |
| 2019/0193931 | A1* | 6/2019 | Kendall | B65D 88/52 |

FOREIGN PATENT DOCUMENTS

| | | | |
|---|---|---|---|
| CN | 103619732 | A | 3/2014 |
| CN | 203473630 | U | 3/2014 |
| DE | 102013100260 | A1 | 7/2013 |
| EP | 878352 | A2 | 11/1998 |
| NL | 2007607 | C | 4/2012 |
| NL | 2009992 | A | 7/2013 |
| WO | 0140064 | A1 | 6/2001 |
| WO | 2006020927 | A1 | 2/2006 |
| WO | 2012057616 | A1 | 5/2012 |
| WO | 2012154036 | A1 | 11/2012 |

OTHER PUBLICATIONS

U.S. Appl. No. 13/815,638, Non-Final Office Action dated Jan. 5, 2015, 22 pages.

U.S. Appl. No. 13/815,638, Final Office Action dated Aug. 19, 2015, 12 pages.

U.S. Appl. No. 62/052,614, filed Sep. 19, 2014, 35 pages.

U.S. Appl. No. 14/490,992, filed Sep. 19, 2014, 187 pages.

PCT Application No. PCT/US2014/062092, International Search Report and Written Opinion, dated Feb. 6, 2015, 7 pages.

PCT Application No. PCT/US2014/062001, International Search Report and Written Opinion, dated Apr. 15, 2015, 10 pages.

PCT Application No. PCT/US2014/062091, International Search Report and Written Opinion, dated Jul. 18, 2014, 9 pages.

U.S. Appl. No. 14/490,992, Office Action dated Feb. 1, 2016, 32 pages.

Chinese Application No. 201520430322, Notice of Grant, dated Jan. 8, 2016, 2 pages.

Chinese Application No. 201480001507.7, Office Action dated Nov. 2, 2015, 18 pages.

PCT Application No. PCT/US2014/062091, International Prelimnary Report on Patentability, dated May 3, 2016, 6 pages.

EP Application No. 16185047A, Extended European Search Report dated May 15, 2017, 10 pages.

* cited by examiner

FIG. 1 – PRIOR ART

FIG. 2 – PRIOR ART

SYSTEM AND METHOD FOR LOCKING WALLS OF A STORAGE CONTAINER

CROSS-REFERENCE TO RELATED APPLICATIONS

This application claims priority to U.S. Provisional Patent Application Ser. No. 62/292,951, filed on Feb. 9, 2016.

TECHNICAL FIELD

The present invention relates generally to a shipping container. More specifically, the present invention relates to a system and method for securing walls of a storage container.

BACKGROUND OF THE INVENTION

The shipping industry uses large cargo containers to ship cargo from one location to another in domestic and global commerce. Such containers are designed to be conveniently moved from one mode of transport to another across the land by road or on rail or over the sea. Such containers are sometimes referred to as "intermodal shipping containers" or "freight containers." The use of such containers has essentially eliminated the need for manually transferring cargo from one vessel to another, or from one vehicle or railcar to another in the effort to deliver the cargo to its final destination.

Today, cargo containers are generally standardized by internationally recognized standards, and by national domestic standards with respect to dimensions and structure. Thus, the standard containers can be securely arranged in vertical stacks in side-by-side and end-to-end relationship with each other, and can be handled most effectively when transferring from one mode of transport to another regardless of their source or destination.

Often, these containers must be transported empty from one delivery point to the next location where cargo is available for shipment. Transport of empty containers costs the shipper money and erodes profits since transport of each such container incurs handling cost and occupies valuable space which could otherwise be used to ship a revenue producing container loaded with cargo. Additionally, the shipping of both loaded and empty containers creates problems such as how to arrange the lighter, empty containers and the heavier, loaded containers aboard ships in such a manner that the safety of the ships is not compromised. Beyond safety issues, the shipment of empty containers causes monetary losses for shippers, losses which result in either substantial financial impact on the shipper or increased charges to customers for the handling and transport of loaded containers. Similar cost disadvantages apply when shipping empty containers over road or by rail.

Long ago shippers recognized that significant economic savings could be realized if empty containers could be "folded" so as to occupy a substantially smaller space when not in use, so that less space need be sacrificed in the transporting of empty containers. Such an effort presently exists only for the "open frame" or flat rack type containers. To that end, the prior art proposed many foldable or nesting cargo containers of the enclosed types intended to reduce the space required for their shipment when empty. While such prior art foldable containers have been proposed, the market has not embraced the prior art containers as a substitute for the standard, non-foldable cargo containers due to these prior art foldable containers not meeting ISO standards and ISO certifications for being water proof.

A shortcoming of foldable containers of the prior art, such as those depicted in FIGS. 1 and 2, is the lack of structural designs which enable or facilitate the folding and un-folding of such containers in a simple and effective manner with commonly available equipment. For example, prior mechanisms for securing container walls together required large amount of force applied to assemble or disassemble the mating components. Such configurations are disadvantageous due to the space constraints and force required.

SUMMARY

The present invention discloses systems and methods for improving the assembly and disassembly of components in a storage container, including a collapsible container. In an embodiment of the present invention, a locking mechanism for a container is provided. The locking mechanism comprises a container having a lower base beam and a corner post to be secured together with an adjustable locking mechanism. The adjustable locking mechanism comprises a pin having a first plurality of teeth along a surface of the pin and a spur gear having a second plurality of teeth and positioned such that the second plurality of teeth engage the first plurality of teeth of the pin. The adjustable locking mechanism also includes a main gear having a third plurality of teeth and positioned such that the third plurality of teeth engage the second plurality of teeth of the spur gear. A handle is fixed to the main gear and capable of causing rotation of the main gear, such that upon rotation of the handle, the main gear rotates, thereby rotating the spur gear, and causing the pin to translate in a linear direction.

In an alternate embodiment of the present invention, a locking mechanism for a collapsible container is provided comprising a pin that translates in a linear direction between a locked and unlocked position, where the linear translation of the pin is parallel to a lower base beam of the collapsible container. The pin has a first plurality of teeth located along a surface of the pin. A spur gear is also provided and has a second plurality of teeth that engage with the first plurality of teeth of the pin. A main gear is connected to the spur gear by way of a third plurality of teeth which are engaged with the second plurality of teeth of the spur gear. A pivoting and rotatable handle is fixed to the main gear such that upon rotation of the handle, the main gear rotates, thereby causing the spur gear to rotate, which in turn, causes linear translation of the pin.

In another embodiment of the present invention, a method of locking a collapsible storage container in a collapsed position is disclosed. The method comprises the steps of unlocking a lower base beam from one or more corner posts of the container when the container is in an erect position, collapsing sidewalls of the container towards a base panel, collapsing a front panel and door panel towards a roof panel, and lowering the roof panel, front panel, and door panel towards the base panel. The roof panel is lowered to a point that a top skirt of the roof panel is in proximity to the lower base beam and a gear-driven locking mechanism. Then, the gear-driven locking mechanism is rotated such that a pin of the gear-driven locking mechanism engages with a portion of the roof panel to lock the roof panel in the collapsed position.

It is an object of the present invention to provide a novel, foldable, enclosed shipping container where the shipping container panels are secured to corner posts with a unique and efficient locking mechanism Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The present invention discloses a system and method for improving the structural connections between mating parts of a storage container. More specifically, embodiments of the present invention relate to systems and methods for improving the way beams of a container are connected to container corner posts. A discussion of the present invention follows and relates to FIGS. 3-10.

Figure 1:
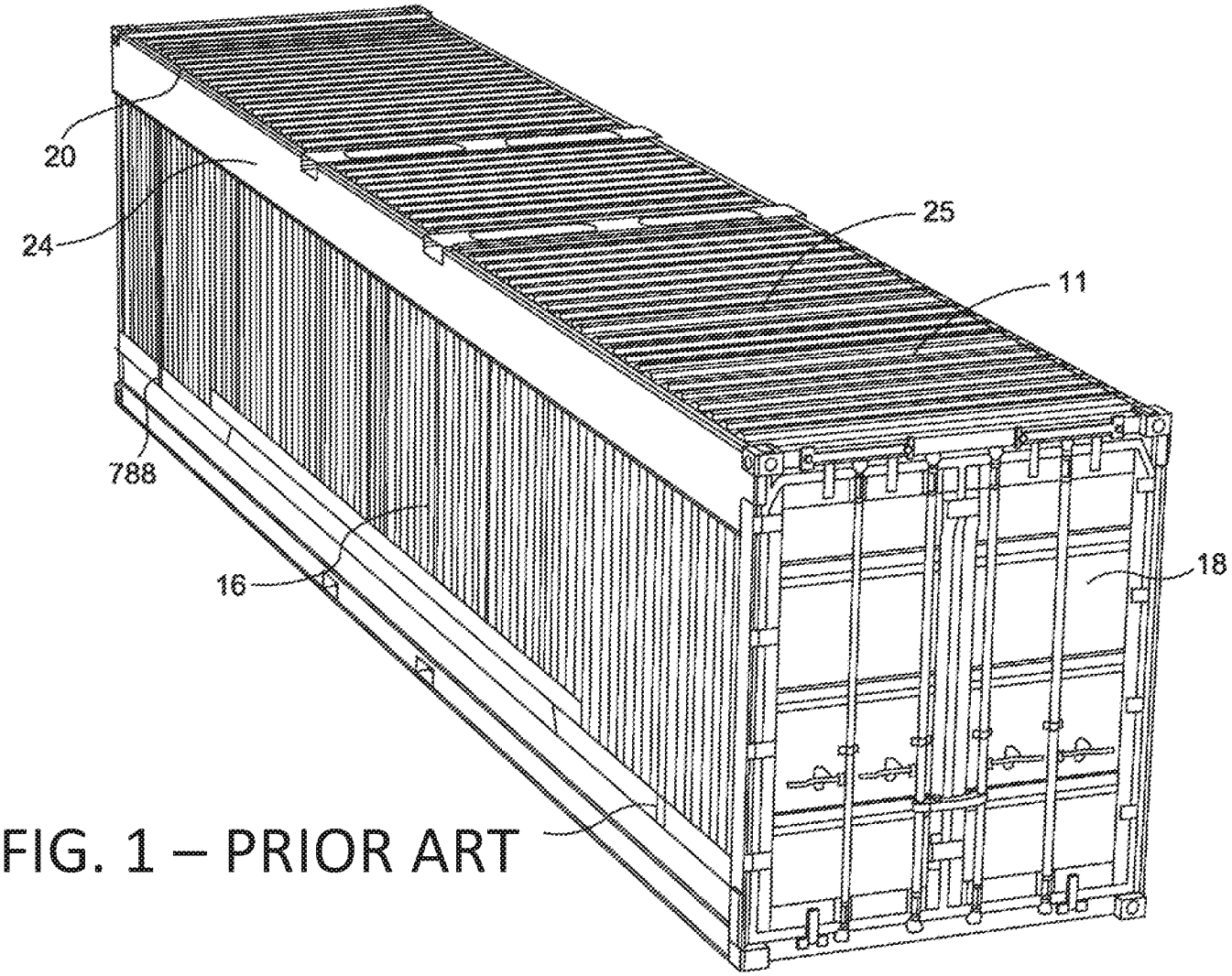
FIG. 1 is a perspective view of a storage container of the prior art.
Figure 2:
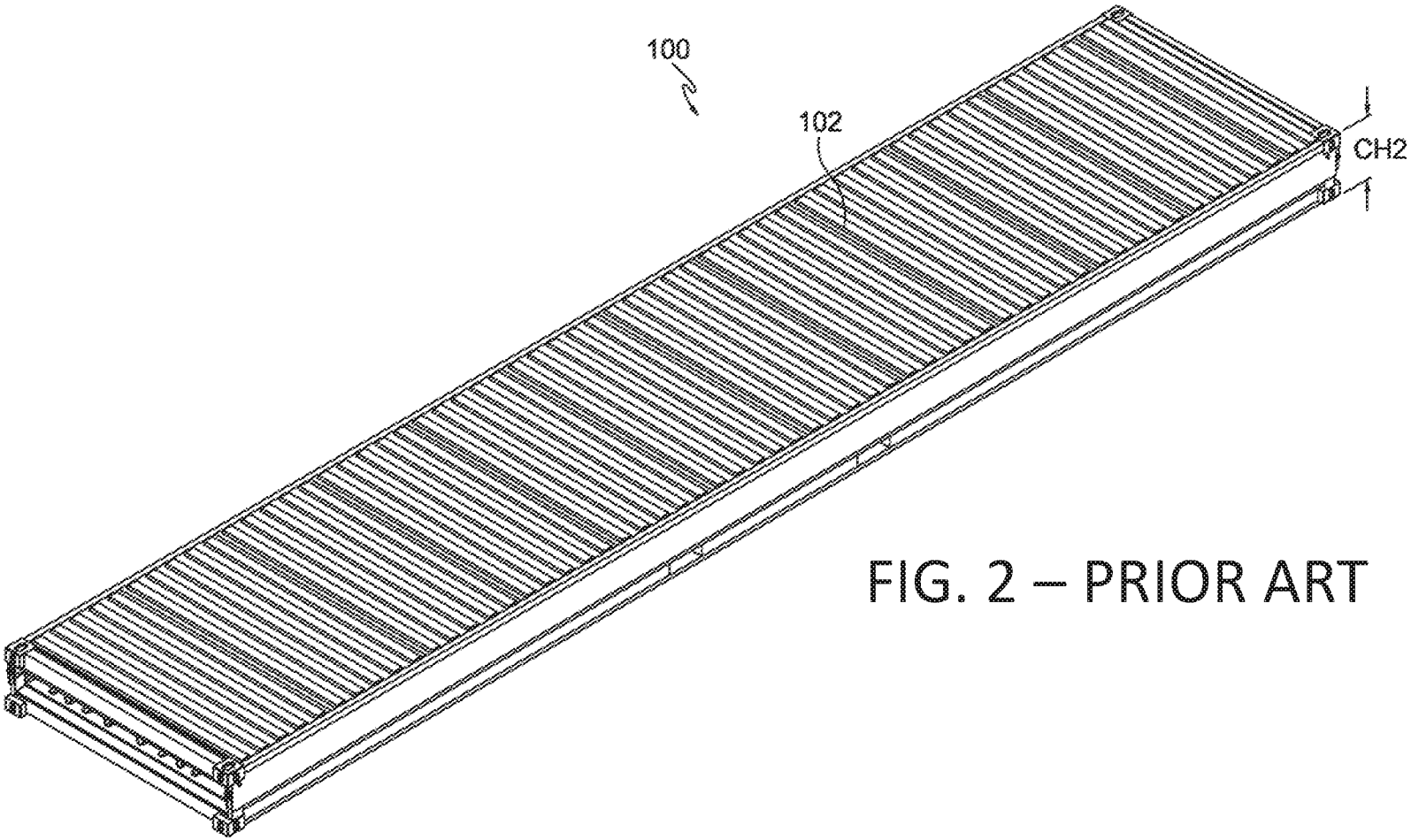
FIG. 2 is a perspective view of a collapsed container of the prior art.
Figure 3:
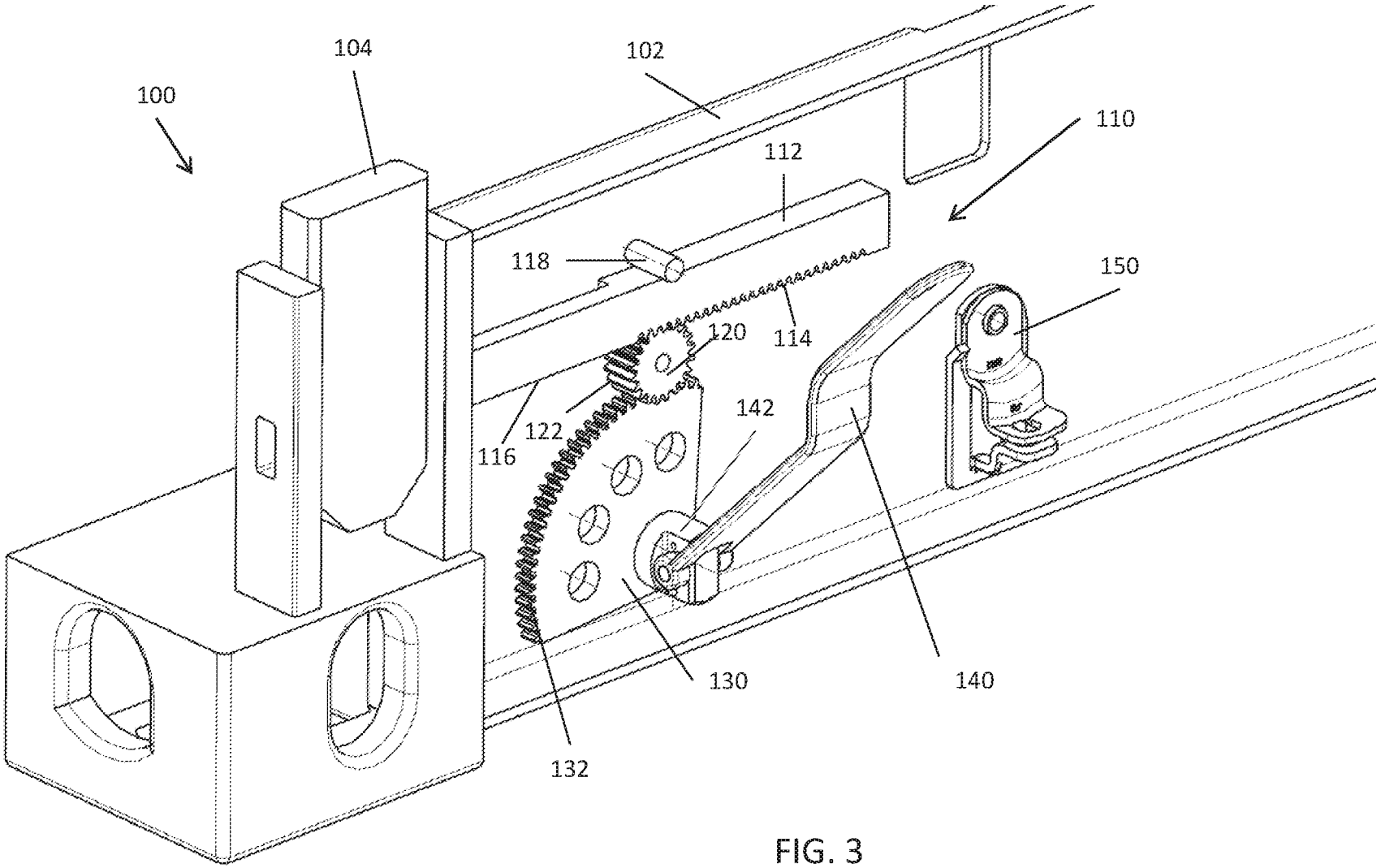
FIG. 3 is a perspective view of a portion of a container lower base beam and corner post containing an embodiment of the present invention.

Referring now to FIG. 3, an embodiment of the present invention is depicted. A locking mechanism 100 for use in a container is shown in perspective view. The locking mechanism is capable of being used on a variety of containers, but especially large containers such as those used for intermodal transport of goods, including those transported by sea, rail, and ground. The present invention is especially useful to aid in the assembly and disassembly of collapsible storage containers, such as those disclosed in co-pending U.S. patent application Ser. Nos. 13/815,638, 14/829,275, 14/490,992, 14/581,383, and 14/587,074, which are hereby enclosed by reference. For example, a representative collapsible container of the present invention comprises a base panel, a roof panel spaced a distance from the base panel and generally parallel to the base panel, a pair of sidewalls extending between the base panel and the roof panel, where the sidewall panels are rotatably coupled to the base panel along a bottom edge of the sidewalls. A door panel and front panel extend between the pair of sidewalls with the door panel and the front panel rotatably coupled to the roof panel.

The locking mechanism 100, as shown in FIG. 3, comprises a lower base beam 102, a corner post 104 adjacent to the lower base beam 102, and an adjustable locking mechanism 110 for securing the lower base beam 102 to the corner post 104. The adjustable locking mechanism 110 comprises a pin 112 having a first plurality of teeth 114 located along a surface 116 of the pin 112. The first plurality of teeth 114 can be located along a bottom surface 116 of the pin 112, as shown in FIG. 3. Alternatively, first plurality of teeth 114 can be located along an opposing top surface. Coupled to the first plurality of teeth 114 is a spur gear 120. The pin 112 is maintained in a vertical position between the spur gear 120 and a locking pin 118. The spur gear 120 has a second plurality of teeth 122 positioned about an outer edge of the spur gear. The second plurality of teeth 122 engages the first plurality of teeth 114, such that upon rotation of the spur gear 120, the pin 112 undergoes a linear translation. For the embodiment depicted in FIGS. 3-8, the spur gear 120 moves the pin 112 into the corner post 104 or away from the corner post 104. The direction of translation depends on the direction of rotation of the spur gear 120. As will be understood from further description below, the spur gear 120 is used in order to connect a main gear to the pin 112 in order for the main gear to be properly positioned to permit its movement when the container is in a collapsed condition.

Figure 5:
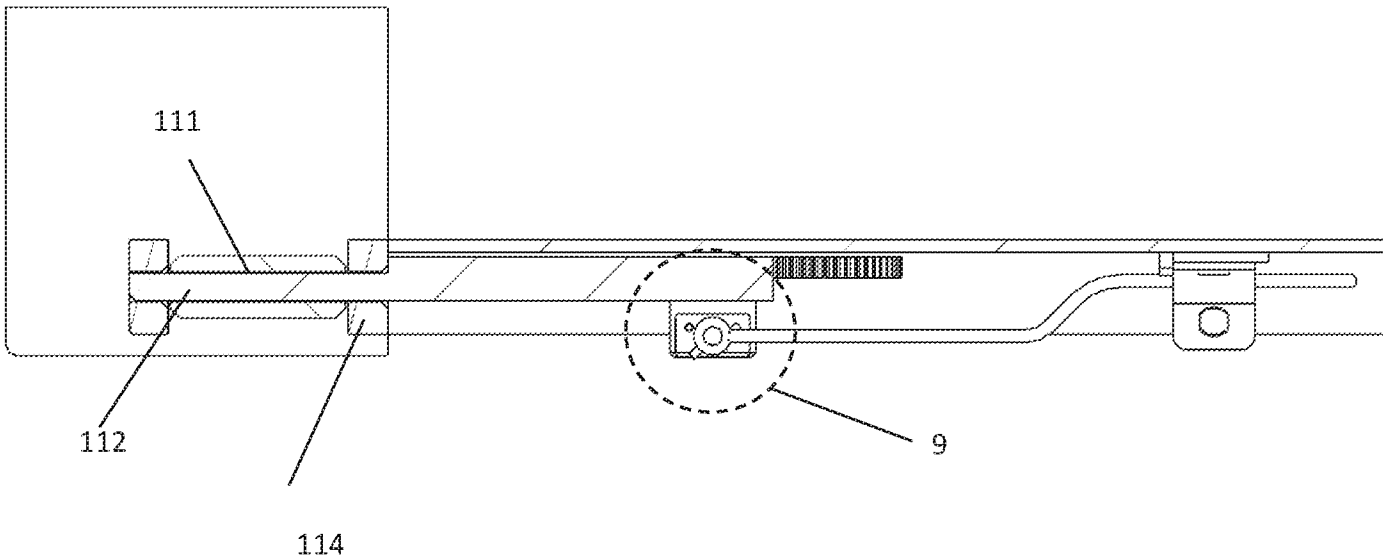
FIG. 5 is a top view of the locking mechanism of FIG. 4 in accordance with an embodiment of the present invention.

As shown in FIG. 5, there is a slot 111 in the corner post 104 configured to receive the pin 112. The slot 111 is adjacent to the pin 112 when the locking mechanism 100 is engaged. When the pin 112 is engaged, it slides into the slot 111 to secure the corner post 104 to the lower base beam 102. The spur gear 120 can move the pin 112 in and out of the slot 111 in the corner post 104.

The adjustable locking mechanism 110 also comprises a main gear 130 having a third plurality of teeth 132 positioned along the perimeter of the main gear. The third plurality of teeth 132 engages the second plurality of teeth 122 of the spur gear 120. As it can be seen from FIGS. 3, 4, and 7, the main gear 130 is ¼ gear capable of rotating up to 90 degrees. Using ¼ gear for the main gear 130 allows for a larger diameter gear to be used, which equates to a larger mechanical advantage for the system.

Figure 4:
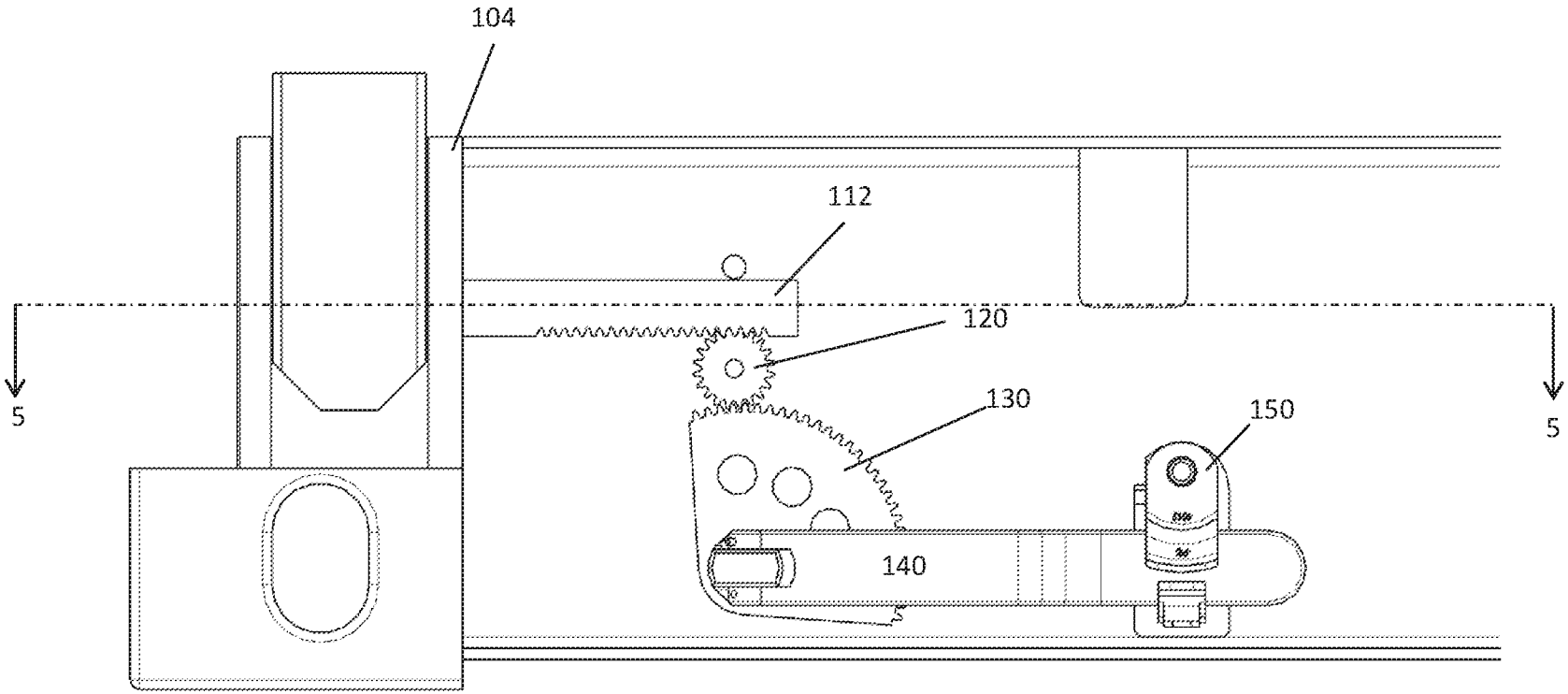
FIG. 4 is an elevation view of the locking mechanism of FIG. 3, depicting the locking mechanism in a locked position, in accordance with an embodiment of the present invention.
Figure 6:
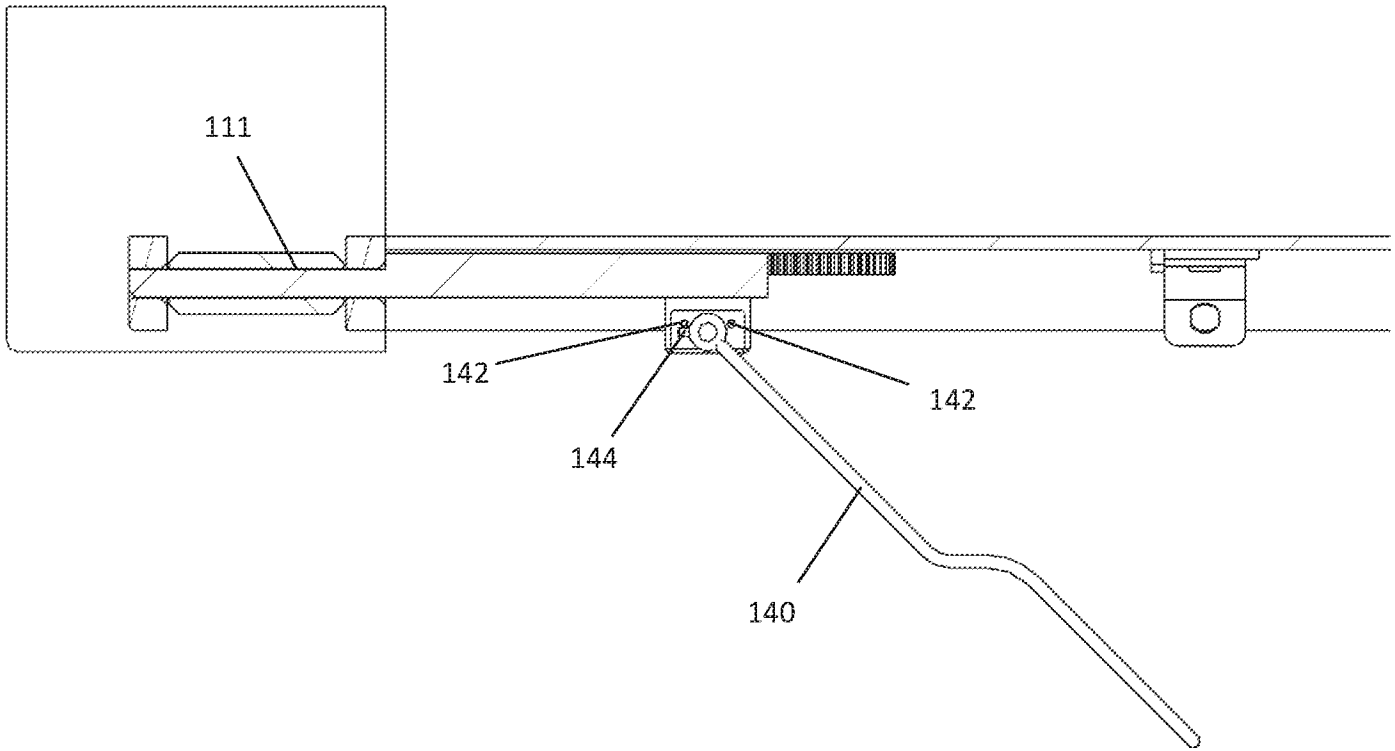
FIG. 6 is a top view of the locking mechanism of FIG. 4 depicting movement of the handle in accordance with an embodiment of the present invention.
Figure 7:
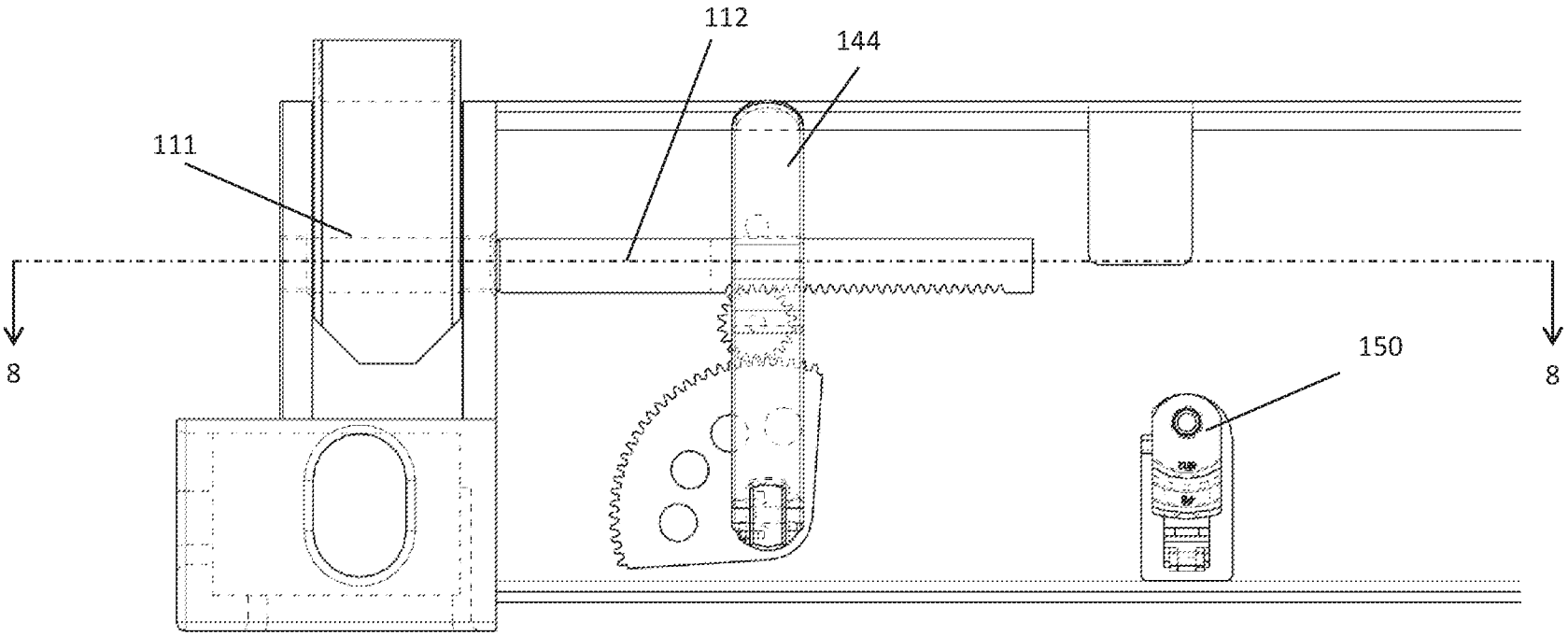
FIG. 7 is an elevation view of the locking mechanism of FIG. 3, depicting the locking mechanism in an unlocked position, in accordance with an embodiment of the present invention.
Figure 8:
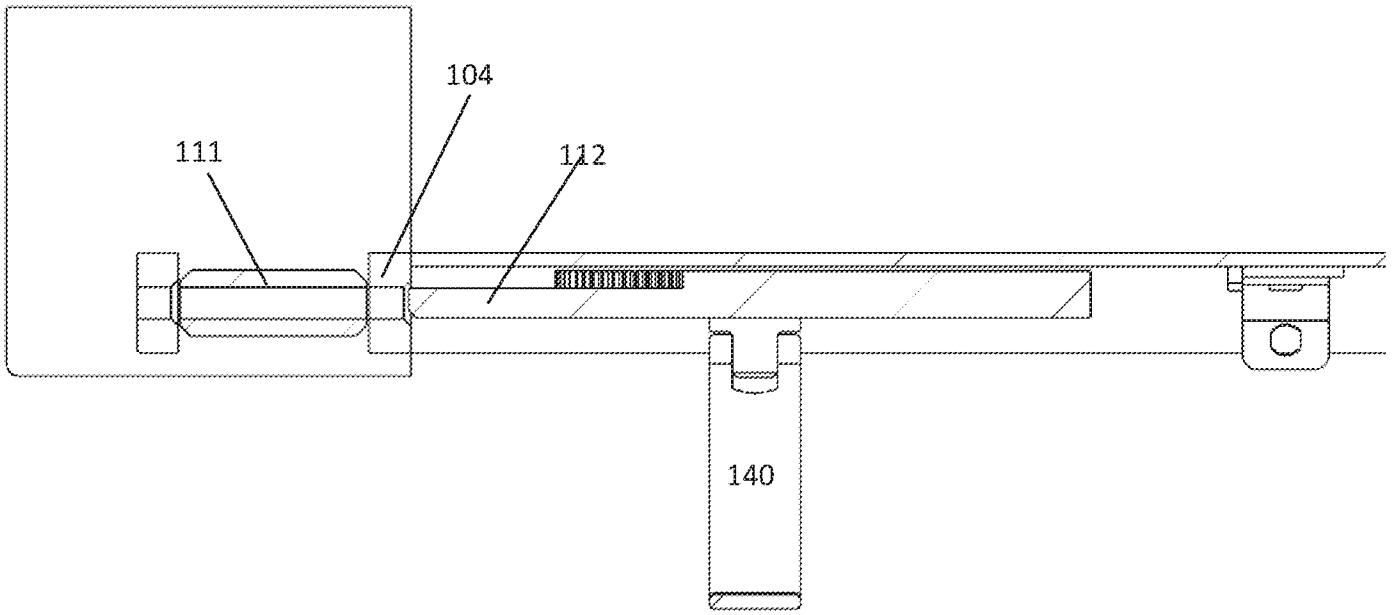
FIG. 8 is a top view of the locking mechanism of FIG. 7 in accordance with an embodiment of the present invention.

A handle 140 is coupled to the main gear 130 through attachment 142. Upon applying a force to the handle 140, the main gear 130 and spur gear 120 will rotate, thereby causing linear translation of the pin 112. More specifically, and with reference to FIGS. 3-8, movement of the pin 112 relative to the handle 140 is depicted. Referring initially to FIG. 4, the handle 140 is in a horizontal position resulting in the pin 112 being positioned in the corner post 104, as shown in FIG. 5. In order to remove the pin 112 from the corner post 104, the handle 140 is rotated in a counter-clockwise direction, thereby causing the main gear 130 to also rotate in a counter-clockwise direction. Rotation of the main gear in a counter-clockwise direction causes the spur gear 120 to rotate clockwise thereby disengaging the pin 112 from the corner post 104. An unlocked, or disengaged pin, configuration is shown in FIGS. 7 and 8 with the pin 112 removed from the corner post 104 and the handle 140 in a generally vertical orientation.

Prior to the handle 140 being able to rotate, a handle lock 150 is to be disengaged. The handle 140 is locked when the pin 112 is engaged in the corner post 104. The exact configuration of the handle lock 150 can vary, but may be similar to that of a door handle lock found on the doors of the container. Locking the handle 140 in place when the pin 112 is engaged provides a safety measure against accidental removal of the pin 112 from the corner post 104.

Figure 9:
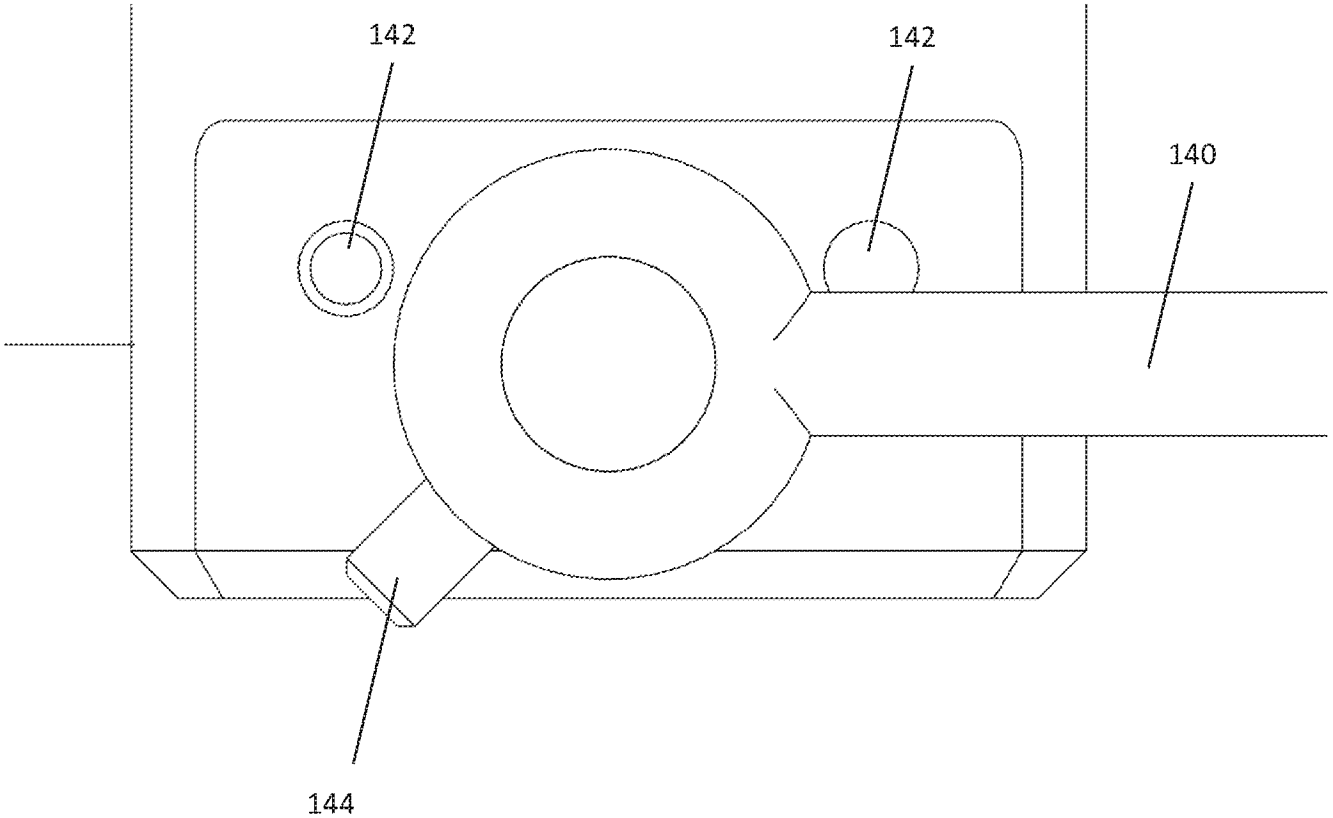
FIG. 9 is a detailed elevation view of a portion of the handle in accordance with an embodiment of the present invention

A further safety feature to prevent accidental rotation of the handle 140, and removal of pin 112, is incorporated through the shape of the handle 140. More specifically, and with respect to FIGS. 3 and 5, the handle 140 has a contoured shape, such that the handle 140 cannot rotate straight upwards, towards a vertical position, without contacting the lower base beam 102 of the container. In order for the handle 140 to rotate and operate the main gear 130 and spur gear 120, it is necessary to first pivot the handle 140 in an outward direction away from the lower base beam 102, as depicted in FIGS. 3 and 6. The handle 140 of the present invention is capable of pivoting outward up to 45 degrees from horizontal or vertical. This pivot feature also provides the necessary clearance for collapsing the container so as to permit enough space for a top skirt of the roof panel to close towards the base panel and allow the handle 140 to then lock the top of the container to the lower base when in the collapsed condition. Referring now to FIGS. 6 and 9, the amount of pivot of handle 140 is controlled by stop pins 142 and a tab 144 extending from the handle 140.

Figure 10:
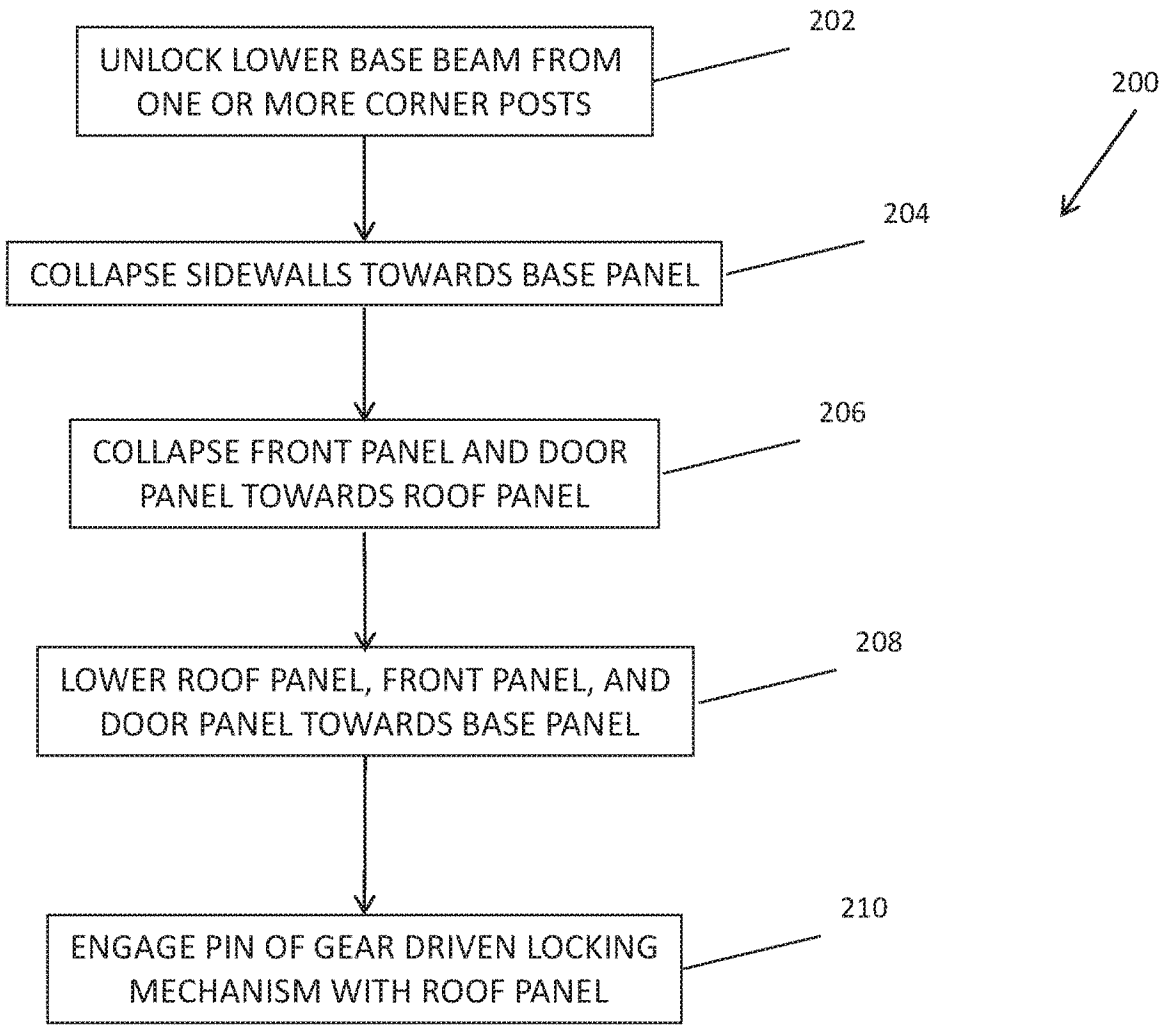
FIG. 10 is a process diagram identifying the steps for using the locking mechanism for a container in both an erect and collapsed condition.

Referring now to FIG. 10, a method of erecting and collapsing the container will be discussed. The method 200 of locking a collapsible storage container in the collapsed position comprises the step 202 of unlocking a lower base beam from one or more corner posts of the container when the container is in an erect position. Then, in a step 204, the sidewalls of the container are collapsed towards a base panel. In a step 206, front panel and door panels are collapsed towards a roof panel. The roof panel, front panel, and door panel are lowered towards the base panel in a step 208, such that a top skirt and/or the roof panel is in proximity to the lower base beam and a gear-driven locking mechanism. Then in a step 210, the gear-driven locking mechanism is rotated such that a pin of the gear-driven locking mechanism engages with a portion of the roof panel.

As used herein, the term "panel" can comprise a single section or in the alternative can be comprised of multiple sections secured together by an acceptable process, such as welded together to form a weldment.

The foldable container 100 of the present invention is folded in a way such that it is capable of being stacked vertically multiple units high when not in use. The container geometry described herein permits the stacking of the containers as described in co-pending U.S. patent application Ser. No. 14/829,275.

The foldable container 100 of the present invention is fabricated from materials capable of withstanding a variety of weather elements and operating conditions. At least the exterior surfaces of the roof panel, base panel, front panel, door panel, and sidewalls are fabricated from corrugated metal, such as CorTen® steel. For example, CorTen® A, also known as A588, is an industry standard acceptable material as this material provides excellent corrosion resistance. This material capability is necessary given the harsh weather conditions experienced by the foldable container, including but not limited to salt water, sea air, rain, snow, and extreme heat and cold. Internal walls of the foldable container 100 can be corrugated metal or can be lined with other materials as desired by the owner/operator of the foldable container 100. Such container material provides the necessary protection of the internal spring assembly components whether the container is in its erect or folded state.

The present invention is applicable to a variety of standard intermodal shipping containers. For example, the folding container and associated spring assembly technology can be configured to accommodate various container lengths as used in the intermodal transport industry including, but not limited to, containers of 10 feet, 20 feet, 24 feet, 40 feet, 48 feet, and 53 feet in length.

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A method of collapsing and locking a collapsible storage container comprising:

unlocking a lower base beam from one or more corner posts of the container in an erect position;

collapsing sidewalls of the container towards a base panel;

collapsing a front panel and door panel towards a roof panel;

lowering the roof panel, front panel, and door panel towards the base panel such that a top skirt of the roof panel is in proximity to the lower base beam and an adjustable locking mechanism, the adjustable locking mechanism comprising a rotatable handle, a rotatable handle retainer, and a pin;

rotating the handle retainer from a first position where the handle retainer is engaged with and preventing the movement of the handle, to a second position where the handle retainer is disengaged from the handle;

rotating the handle in a first direction away from the handle retainer to permit movement of the pin; and, moving the handle in a second direction to slide the adjustable locking mechanism such that the pin translates laterally and securely engages with a portion of the roof panel thereby securing the roof panel to the base panel.

2. The method of claim 1, wherein a lateral translation of the adjustable locking mechanism is parallel to an adjacent edge of the lower base beam.

3. The method of claim 1, wherein the unlocking of the lower base beam from the one or more corner posts occurs by lateral movement of the adjustable locking mechanism causing the pin to slide axially and disengage from the one or more corner posts.

4. The method of claim 1, wherein the sidewalls are collapsed towards the base panel by rotating each of the sidewalls about a rotatable coupling, the rotatable coupling being located along a lower portion of each of the sidewalls and rotatably coupling the sidewalls to the base panel.

5. The method of claim 1, wherein the front panel and the door panel are collapsed towards the roof panel by rotating each of the front panel and the door panel about a rotatable coupling, the rotatable coupling being located along an upper portion of each of the front panel and the door panel and rotatably coupling the front panel and the door panel to the roof panel.

6. The method of claim 1, wherein the adjustable locking mechanism is located along an exterior surface of the lower base beam.

7. The method of claim 1, wherein the portion of the roof panel comprises a receiving slot for engaging with the pin of the adjustable locking mechanism.

8. The method of claim 1, wherein each of the side walls comprise a plurality of sections secured together.

9. The method of claim 1, wherein each of the one or more corner posts comprises an aperture for receiving the pin.

10. The method of claim 1, wherein the collapsible storage container comprises corrugated metal.

11. A method of collapsing and securing a collapsible storage container comprising:

unlocking a lower base beam from one or more corner posts of the container in an erect position;

collapsing sidewalls of the container towards a base panel;

collapsing a front panel and door panel towards a roof panel;

lowering the roof panel, front panel, and door panel towards the base panel such that a top skirt of the roof panel is in proximity to the lower base beam and an adjustable locking mechanism, the adjustable locking mechanism comprising a rotatable handle, a rotatable handle retainer, and a pin;

adjusting the adjustable locking mechanism such that the pin of the adjustable locking mechanism engages with a portion of the roof panel; and securing the adjustable locking mechanism in place by rotating the handle retainer to engage with the handle, thereby securing the roof panel to the base panel.

12. The method of claim 11, wherein the sidewalls are collapsed towards the base panel by rotating each of the sidewalls about a rotatable coupling, the rotatable coupling being located along a lower portion of each of the sidewalls and rotatably coupling the sidewalls to the base panel.

13. The method of claim 11, wherein the front panel and the door panel are collapsed towards the roof panel by rotating each of the front panel and the door panel about a rotatable coupling, the rotatable coupling being located along an upper portion of each of the front panel and the door panel and rotatably coupling the front panel and the door panel to the roof panel.

14. The method of claim 11, wherein the portion of the roof panel comprises a receiving slot for engaging with the pin of the adjustable locking mechanism.

15. The method of claim 11, wherein each of the side walls comprises a plurality of sections secured together.

16. The method of claim 11, wherein each of the one or more corner posts comprises an aperture for receiving the pin.

* * * * *